United States Patent [19]

Green

[11] Patent Number: 4,722,119

[45] Date of Patent: Feb. 2, 1988

[54] ANTI-THEFT FASTENING DEVICE

[76] Inventor: Perry A. Green, 119 Bonito Blvd., La Luz, N. Mex. 88337

[21] Appl. No.: 721,090

[22] Filed: Apr. 8, 1985

[51] Int. Cl.[4] ..... A44B 9/18

[52] U.S. Cl. ..... 24/155 BR; 292/316; 24/155 BB; 24/155 R

[58] Field of Search ..... 340/572; 24/150 R, 155 BR, 24/155 R, 155 RB, 155 BB; 116/204; 292/316

[56] References Cited

U.S. PATENT DOCUMENTS

| | | | |
|---|---|---|---|
| 3,858,280 | 1/1975 | Martens | 24/155 BR |
| 3,911,534 | 10/1975 | Martens et al. | 340/572 |
| 3,947,930 | 4/1976 | Martens | 24/155 BR |
| 3,995,900 | 12/1976 | Humble et al. | 292/316 |
| 4,012,813 | 3/1977 | Martens | 24/150 R |
| 4,156,302 | 5/1979 | Van Niel | 24/155 RB |
| 4,299,870 | 11/1981 | Humble | 24/150 R |
| 4,311,992 | 1/1982 | De Chant | 340/572 |
| 4,380,097 | 4/1983 | Keifer | 340/572 |
| 4,502,717 | 3/1985 | Close | 292/316 |

*Primary Examiner*—Charles Frankfort
*Assistant Examiner*—Thomas B. Will

[57] ABSTRACT

A fastening device which is of one piece construction of a ferromagnetic material, having in it formed a pair of jaws through which a fastening pin is inserted and tightly engaged from reverse travel due to the inward bias and angle of the jaws, thereby preventing unauthorized removal.

Removal of the pin is accomplished when the jaws are spread slightly due to a magnetic force attracting a formed upper end or loop and the resulting motion being transmitted through a riser to integral lever arms which through mechanical advantage flex the base thereby spreading the jaws apart.

17 Claims, 5 Drawing Figures

ANTI-THEFT FASTENING DEVICE

BACKGROUND OF THE INVENTION

The present invention relates as indicated to an anti-theft locking device, and more particularly to a locking device particularly adapted to be used in a system for preventing unauthorized removal of articles from department stores, boutiques, or the like where the identification tag must be removed from the article purchased during the check-out process. In accordance with the invention, the locking device is securely mounted in an identification tag, with the lock being securely attached to articles of merchandise in such a manner that the lock can be opened or separated only by the use of a special tool which can be conveniently located at the checkout point in the department store or similar establishment. The lock tightly frictionally engages a pin which extends through the protected article, with the actuation of the releasing tool permitting the pin to be released and the lock and tag removed from the article for normal purchsed items. If a person attempts to surreptitiously remove the article from the store without purchasing the same and consequently effecting removal of the identification tag and lock, the construction of the tag and the complete system permits an alarm system to be actuated at an exit point or points in the store thereby notifying the store operators of the unauthorized removal of the article from the premises.

Locking devices similar in response to the locking device of the present invention are disclosed in U.S. Pat. Nos. 3,858,280 to Martin A. J. Martens and 3,911,534 to Henry J. Martens et al. Reference is made to these patents for a complete understanding of an anti-theft system and the specific construction of an identification tag with which the locking device of the present invention may be employed. It should be noted in this regard that the identification tag will be referred to herein below only for a full understanding of the typical use of the present invention, with the construction of the tag forming no part thereof. Furthermore, the present invention may be used in conjunction with any type of tag system which incorporates a lock utilizing a frictionally engaged pin, and reference to the particular tag system described in the cited patents is in o way meant to limit the application of the present invention. In addition, it will be seen that the present invention can be used in any situation where it is desired to temporarily secure two or more members together, and reference to its use in an article security system is in no way meant to limit the application of the present invention.

Similarly, the detaching tool by means of which the locking device can be separated from the members secured thereto forms no part of the present invention, and reference is made to U.S. Pat. Nos. 3,911,534 and 4,221,026 to Henry J. Martens et al. which disclose a detaching tool which can be satisfactorily employed with the locking device of the present invention.

With regard to known prior art, the most relevant art with which applicant is familiar is the aforesaid U.S. Pat. Nos. 3,911,534 and 4,221,025. In the patented fastening device, positioned within the housing or cap of the fastener is an insert containing both a longitudinal opening for receiving the pin and transverse openings for receiving the retaining balls. The latter, upon insertion of the pin into the insert and housing, were cammed against an anular ring frictionally retained within the housing around the insert. Upon insertion of the pin, the insert was caused to more upwardly within the housing against spring bias, with release of the pin preventing the same from being withdrawn due to the tight frictional engagement of the ball surfaces with the pin and the adjacent surfaces of the ring. Removal of the pin was effected by placing the fastening device adjacent the detaching tool which, when actuated, electromagnetically moved the insert, formed of magnetizable material, upwardly in the housing thereby permitting the retaining balls to move upwardly along the cam surface of the ring and out of tight frictional engagement with the pin. The pin and tag with the fastening device could then be removed and separately stored for reuse.

Although the above described structure provided highly satisfactory results in commercial use over an extended period of time, it did possess certain disadvantages in terms of cost both with respect to material parts and also labor costs required to assembly the fastening device.

SUMMARY OF THE INVENTION

With the above in mind, a primary object of the present invention is to provide a locking device which can be quickly and easily secured to the articles to be protected or held together, while simultaneously providing a locking arrangement which precludes separation of the pin from the lock without a special detaching tool.

A further object of the invention is to provide such a locking device in which substantial savings of both material and labor are achieved. In accordance with the invention, the entire device may be of one piece construction. In the locking mode, the pin is inserted between the lock's two jaws via a hole in the tag's casing. The jaws are spread slightly by the pin, causing the jaws to be biased inwardly into tight frictional engagement with the pin thereby preventing a reverse directional travel of the pin.

In the release mode, the loop is moved upwardly away from the base either by an external magnetic force acting on the material of the loop or by a special insertable tool mad eto grasp the loop's end, and the pulling force so generated is transmitted by at least one riser to at least one integral lever arm, which integral lever arm provide a leverage to slightly curve the base of the lock from its center or relaxed position. As a result, the jaw faces are spread sufficiently apart to allow removal of the pin.

BRIEF DESCRIPTION OF THE DRAWINGS

FIG. 5 is an oblique persepctive view of the invention showing another means of construction wherein the invention is not formed from one piece.

DESCRIPTION OF THE PREFERRED EMBODIMENT

Figure 1:
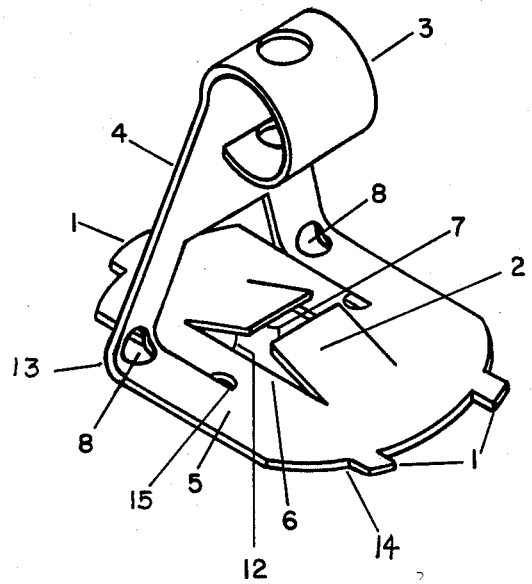
FIG. 1 is an oblique perspective view of the present invention shown along with a typical mechanical detaching tool.

Referring now to FIG. 1, it can be seen that the fastener of the present invention is formed from a single piece of material. In the figure, 1 are the base tabs which are held captive by the housing from movement relative to the other components of the fastener. 2 are the jaws, the angle 12 of which in relation to the base 6 is set to be small enough to grip the pin effectively, that is the gap without the piin inserted is set to be smaller than the pin diameter, but not so small as to generate forces which would deform the base 6 when the pin is inserted. 3 is a loop which is made of a ferromagntic material and to which additional ferromagnetic material may be attached to make the fastener operable with existing magnetic release systems. 4 are risers which transmit the upward force generated by the magnetic field of the releasing tool pulling on the ferromagnetic loop 3 to the integral lever arms 5. Each integral lever arm 5 has a pivot point or fulcrum at point 14 at the end of the construction which is further restrained from vertical movement by action of the housing on the base tabs. The length of the longer moment arm of 5 corresponds to the distance between the bend to the riser at point 13 and the fulcrum at point 14 at the end of the construction. The length of the shorter moment of arm 5 corresponds to the distance between the end of the cut at point 15 forming the extension of 5 and the fulcrum at point 14 at the end of the construction. When the loop is pulled upwards, the lever arms apply an upward force to the base 6 approximately about the point 15 exerting a mechanical advantage which is proportional to the ratio of the longer arm to the shorter arm. The integral lever arms 5 provide leverage to slightly curve the base 6 upwards from its center or relaxed positon and thereby widen the jaw gap dimension 7 when the loop 3 is moved upwardly under the magnetic pulling force of a releasing tool. The relative lengths of the two moment arms determined by the placement of point 15 can be adjusted to obtain different mechanical advantages, but the placement of point 15 should be such that the lever arms will flex the base adjacent the gap between the attached ends of the jaw members 2 in order to displace both halves of the jaws approximately the same amount. The holes 8 in the bend between the integral lever arms 5 and the risers 4 allow the relatively free angular movement between the two parts through the small amount of arc necessary for the releasing operation.

Also shown in FIG. 1 is a releasing tool 17 by which direct mechanical force may be applied to the loop at the top of the riser. Tool 17 forms no part of the present invention.

Figure 2:
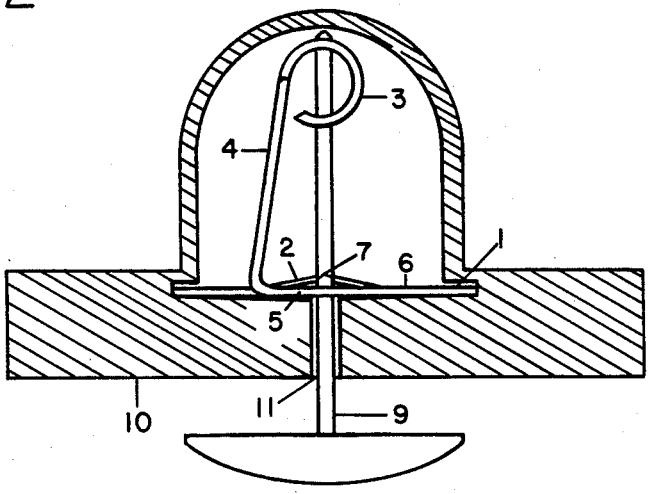
FIG. 2 is a side elevational view of the locking device and pin in the locked mode, shown installed in a sectional view of a typical tag housing.

The locking operation of this invention will now be described with reference to FIG. 2. Pin 9 is inserted between the jaws 2 toward the loop 3 through a hole 11 in the tag body 10. The jaws are spread slightly by the pin 9, which creates an upward biasing of the jaws caused by the tension from the base 6 being flexed from its normal or relaxed position. Reversing direction, or trying to pull the pin 9 from the fastener causes the inward force of the jaws 2 on the pin 9 to increase as a product of twice the pulling force on the pin 9 times the contangent of the angle 12 of the jaws 2, and removal of the pin is virtually impossible.

Figure 3:
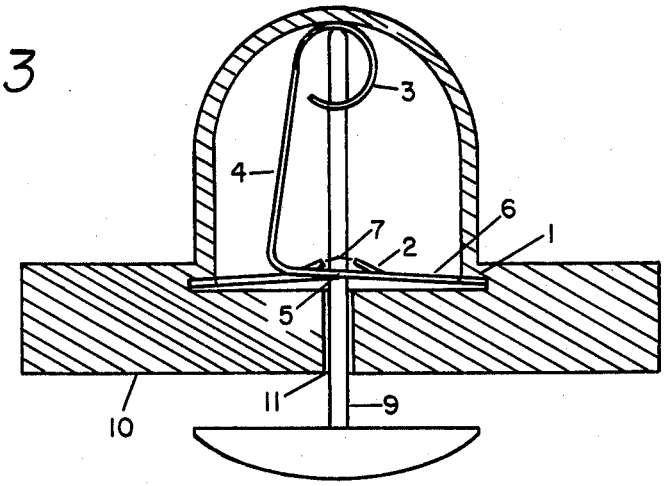
FIG. 3 is a side elevational view of the locking device and pin in the release mode, shown installed in a sectional view of a typical tag housing.

The releasing or unlocking operation of this invention will now be described in further detail. In FIG. 3 a releasing tool held above the housing approximately perpendicular to the long axis of the pin through the fastener applies a stong magnetic field to the ferromagnetic material of loop 3 thereby drawing loop 3 upwards away from the base 6 and base tabs 1. The force of this movement is transmitted to the integral lever arms 5 by the risers 4. The force on and leverage of the integral lever arms 5 flexes the base 6 in the same direction relative to the base as the loop 3, which increases the jaw gap dimension 7 sufficiently to allow free movement and removal of pin 9.

Figure 4:
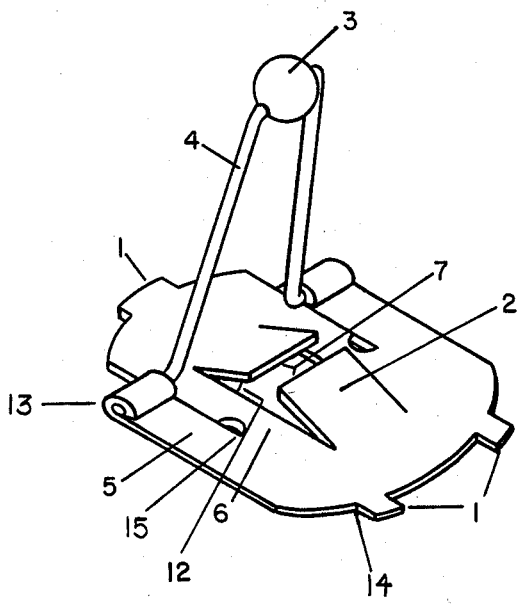
FIG. 4 is an oblique perspective view of the invention showing another means of construction.

FIG. 4 shows another embodiment of the present invention wherein the risers 4 are not formed as an integral part along with a loop and lever arms 5, and a ferromagnetic mass 3 is attached to the risers 4 in place of the loop.

FIG. 5 shows another embodiment of the present invention wherein the lever arms 5 are not formed as an integral part along with the base 6, risers 4, and ferromagnetic mass 18, but are separately formed and securely attached to the base 6 at point 16.

I claim:

1. A fastening device for securing two or more articles together comprising:

(a) a base portion formed to have centrally located two opposing jaws forming an elongated narrow opening and being bent at a calculated angle from said base portion to provide a separation between the jaws which will allow for insertion of a pin from one direction but prevent the pin from being withdrawn in the opposite direction, said base also having extensions by which the base may be held captive.

(b) at least one elongated lever arm having a free end, said at least one lever arm being located at the side of the base and lying substantially in the plane of the base and having its longer dimension in a direction perpendicular to the narrow opening formed by the jaws, said at least one lever arm being attached to the base so as to provide mechanical advantage when said at least one lever arm is moved at its free end, the force transferred through the mechanical advantage resulting from movement of said at least one lever arm at its free end being applied to the base substantially between the bends defining the jaws causing a distortion to the central portion of the base relataive to is ends which results in the jaws being moved toward or away from each other;

(c) at least one riser having an upper end and a lower end, said lower end being pivotally attached to the free end of said at least one lever arm, said at least one risesr transmits movement and force from said upper end to the free end of said at least one lever arm, said at least one riser designed to move said at least one lever arm freely on an arc to a sufficient degree necessary to flex the base for an unlock operation, (d) a means for transmitting force attached to said upper end of said at least one riser which when acted on by external forces transmits force and movement to said at least one riser;

wherein when said pin is inserted between said jaws, it is locked in place and can only be removed when sufficient force is transmitted through said transmitting means to cause said at least one riser to move said at least one lever arm in a direction which will move said jaws away from each other to unlock said pin from said jaws.

2. The fastening device of claim 1 having a plurality of lever arms and a plurality of risers but wherein the number of lever arms is always equal to the number of risers.

3. The fastening device of claim 1 or claim 2 wherein the means for transmitting force comprises ferromagnetic material attached to the free end(s) of the riser(s).

4. The fastening device of claim 3 in which there is a hole in the ferromagnetic material shown through which the pin may pass.

5. The fastening device of claim 1 or claim 2 wherein the means for transmitting force comprises a loop or formed end attached to the riser which may be hooked or grasped by a teaching tool.

6. The fastening device of claim 6 in which there is a hole in the formed end or loop through which the pin may pass.

7. The fastening device of claim 1 or claim 2 wherein the base base, lever arm(s), and riser(s) are of one piece construction being formed from a single piece of material.

8. The fastening device of claim 7 wherein the means for transmitting force comprises ferromagnetic material attached to the free end(s) of the riser(s).

9. The fastening device of claim 8 in which there is a hole in the ferromagnetic material through which the pin may pass.

10. The fastening device of claim 7 wherein the means for transmitting force comprises a loop or formed end attached to the riser(s) which may be hooked or grasped by a detaching tool.

11. The fastening device of claim 10 in which there is a hole in the formed end or loop through which the pin may pass.

12. The fastening device of claim 7 wherein the material is ferromagnetic.

13. The fastening device of claim 12 wherein the means for transmitting force comprises ferromagnetic material attached to the free end(s) of the riser(s).

14. The fastening device of claim 13 in which there is a hole in the ferromagnetic material through which the pin may pass.

15. The fastening device of claim 12 wherein the means for transmitting force comprises a loop or formed end integrally formed and attached to the riser(s).

16. The fastening device of claim 15 which there is a hole in the formed end or loop through which the pin may pass.

17. The fastening device of claim 16 wherein the loop or formed end may be hooked or grasped by a detaching tool.

* * * * *